US007226712B2

(12) United States Patent
Fuller et al.

(10) Patent No.: US 7,226,712 B2
(45) Date of Patent: Jun. 5, 2007

(54) PHOTOCONDUCTIVE IMAGING MEMBERS HAVING PYROLYZED POLYACRYLONITRILE HOLE BLOCKING LAYER

(75) Inventors: Timothy J. Fuller, Pittsford, NY (US); Helen R. Cherniack, Rochester, NY (US); Damodar M. Pai, Fairport, NY (US); Markus R. Silvestri, Fairport, NY (US); John F. Yanus, Webster, NY (US); Yuhua Tong, Webster, NY (US); Dale S. Renfer, Webster, NY (US); Kenny-Tuan T. Dinh, Webster, NY (US); Merlin E. Scharfe, Penfield, NY (US); Steven M. Sterling, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/302,877

(22) Filed: Dec. 14, 2005

(65) Prior Publication Data

US 2006/0099527 A1 May 11, 2006

Related U.S. Application Data

(62) Division of application No. 10/774,636, filed on Feb. 9, 2004, now Pat. No. 7,049,038.

(51) Int. Cl.
*G03G 5/14* (2006.01)

(52) U.S. Cl. ..... 430/58.8; 430/64; 430/65

(58) Field of Classification Search ..... 430/64, 430/65, 58.8
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,578,333 | A * | 3/1986 | Staudenmayer et al. | 430/60 |
| 5,874,193 | A * | 2/1999 | Liu et al. | 430/58.8 |
| 6,015,645 | A | 1/2000 | Murti et al. | 430/59 |
| 6,255,027 | B1 | 7/2001 | Wehelie et al. | 430/65 |
| 6,287,737 | B1 | 9/2001 | Ong et al. | 430/58.8 |
| 6,913,863 | B2 | 7/2005 | Wu et al. | 430/58.8 |

* cited by examiner

*Primary Examiner*—Christopher Rodee
(74) *Attorney, Agent, or Firm*—Eugene O. Palazzo; Fay Sharpe LLP

(57) ABSTRACT

A photoconductive imaging member comprised of an optional supporting substrate, a hole blocking layer thereover, a photogenerating layer, and a charge transport layer, and wherein the hole blocking layer is comprised of a pyrolyzed polyacrylonitrile.

34 Claims, No Drawings

PHOTOCONDUCTIVE IMAGING MEMBERS HAVING PYROLYZED POLYACRYLONITRILE HOLE BLOCKING LAYER

CROSS-REFERENCE TO RELATED APPLICATIONS

This is a divisional of U.S. application Ser. No. 10/774,636 filed Feb. 9, 2004, now U.S. Pat. No. 7,049,038 by the same inventors, and claims priority therefrom.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer generated, for example, from the reaction of a silyl-functionalized hydroxyalkyl polymer of Formula (I) with an organosilane of Formula (II) and water (I)

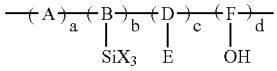

(II)

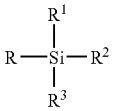

wherein, for example, A, B, D, and F represent the segments of the polymer backbone; E is an electron transporting moiety; Z is selected from the group consisting of chloride, bromide, iodide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl, with the substituent being halide, alkoxy, aryloxy, and amino; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 6,913,863, the disclosure of which is totally incorporated herein by reference, is a photoconductive imaging member comprised of an optional supporting substrate, a hole blocking layer thereover, a photogenerating layer, and a charge transport layer, and wherein the hole blocking layer is comprised of a metal oxide, a mixture of phenolic resins and wherein at least one of the resins contains two hydroxy groups.

Illustrated in U.S. Pat. Nos. 6,255,027; 6,177,219, and 6,156,468, each of the disclosures thereof being totally incorporated herein by reference, are, for example, photoreceptors containing a charge blocking layer of a plurality of light scattering particles dispersed in a binder, reference for example, Example I of U.S. Pat. No. 6,156,468, wherein there is illustrated a charge blocking layer of titanium dioxide dispersed in a specific linear phenolic binder of VARCUM®, available from OxyChemical Company.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Illustrated in U.S. Pat. No. 5,521,043, the disclosure of which is totally incorporated herein by reference, are photoconductive imaging members comprised of a supporting substrate, a photogenerating layer of hydroxygallium phthalocyanine, a charge transport layer, a photogenerating layer of BZP perylene, which is preferably a mixture of bisbenzimidazo(2,1-a-1',2'-b)anthra(2,1,9-def:6,5,10-d'e'f')diisoquinoline-6,11-dione and bisbenzimidazo(2,1-a:2',1'-a)anthra(2,1,9-def:6,5,10-d'e'f')diisoquinoline-10, 21-dione, reference U.S. Pat. No. 4,587,189, the disclosure of which is totally incorporated herein by reference; and as a top layer a second charge transport layer.

The appropriate components and processes of the above copending applications may be selected for the present invention in embodiments thereof.

BACKGROUND

This invention is generally directed to imaging members, and more specifically, the present invention is directed to single and multilayered photoconductive imaging members with a hole blocking, or undercoat layer (UCL) comprised of, for example, a pyrolyzed polyacrylonitrile, and which pyrolyzed polyacrylonitrile can in embodiments be overcoated, dispersed in a suitable binder, and the like, depending, for example, on the form of the layer, that is when applied as a continuous layer the pyrolyzed polyacrylonitrile is preferably overcoated with a silane material, such as 3-aminopropyltriethoxysilane (APS). Moreover, in embodiments the pyrolyzed polyacrylonitrile can be dispersed in a binder of, for example, a binder comprised of a phenolic resin, reference U.S. Pat. Nos. 6,255,027; 6,177,219, and 6,156,468, and which layer can be deposited on a supporting substrate. More specifically, the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, perylenes, titanyl phthalocyanines, selenium, selenium alloys, and the like. The imaging members of the present invention in embodiments exhibit excellent cyclic/environmental stability, and substantially no adverse changes in their performance over extended time periods, since the imaging members comprise a mechanically robust and solvent resistant hole blocking layer, enabling the coating of a subsequent photogenerating layer thereon without structural damage; excellent $V_{low}$, that is the surface potential of the imaging member subsequent to a certain light exposure, minimal or substantially no plywood effects, excellent charge acceptance, low dark decay, rapid voltage discharge decay curves, low voltage residuals, and which blocking layer can be easily coated on the supporting substrate by various coating techniques of, for example, dip or slot-coating. The aforementioned photoresponsive, or photoconductive imaging members can be negatively charged when the photogenerating layers are situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

The imaging members illustrated herein and containing an undercoat layer of pyrolyzed polyacrylonitrite (PPAN) is substantially insensitive to (1) solvents, such as organic solvents, like methylene chloride; (2) changes in environmental conditions and heat; and is (3) substantially antireflective thereby suppressing plywood print pattern defects; and (4), thicker undercoat layers can be selected resulting, for example, in photoconductive members with economical substrates.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The use of perylene pigments as photoconductive substances is also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

SUMMARY

It is a feature of the present invention to provide imaging members with many of the advantages illustrated herein, such as substantially no adverse plywood effects, excellent photoconductive electrical characteristics, stability in xerographic cycling scanner testing, substantial insensitivity to organic solvents, a rapid curing of the hole blocking layer during device fabrication, for example of about equal to, or less than about one minute, for example from about 5 to about 60 seconds, and which layer also prevents, or minimizes dark injection, and wherein the resulting photoconducting members possess, for example, excellent photoinduced discharge characteristics, cyclic and environmental stability and acceptable charge deficient spot levels arising from dark injection of charge carriers.

Another feature of the present invention relates to the provision of layered photoresponsive imaging members, which are responsive to near infrared radiation of from about 700 to about 900 nanometers.

It is yet another feature of the present invention to provide layered photoresponsive imaging members with a sensitivity to visible light.

Moreover, another feature of the present invention relates to the provision of layered photoresponsive imaging members with mechanically robust and solvent resistant hole blocking layers.

Additionally, in another feature of the present invention there is provided a hole blocking layer comprised of a dispersion of pyrolyzed polyacrylonitrile (PPAN), titanium oxide, a phenolic resin, or a mixture of phenolic resins comprised of a first linear, or a first nonlinear phenolic resin, and a second phenolic resin containing at least two hydroxy groups, and which blocking layer is applied to a drum of, for example, aluminum and cured at a high temperature of, for example, from about 135° C. to about 165° C.

Aspects of the present invention relate to a photoconductive imaging member comprised of an optional supporting substrate, a hole blocking layer thereover, a photogenerating layer, and a charge transport layer, and wherein the hole blocking layer is comprised of a pyrolyzed polyacrylonitrile; a photoconductive imaging member containing a photogenerating layer, a charge transport layer, and a pyrolyzed polyacrylonitrile hole blocking layer; a photoconductive imaging member comprised in sequence of a supporting substrate, a hole blocking layer thereover, a photogenerating layer, and a charge transport layer, and wherein the hole blocking layer is comprised of a pyrolyzed polyacrylonitrile; a photoconductive imaging member comprised of a supporting substrate, a hole blocking layer thereover, a photogenerating layer and a charge transport layer, and wherein the hole blocking layer is comprised of a pyrolyzed polyacrylonitrile (PPAN), a dispersion of a pyrolyzed polyacrylonitrile, a metal oxide, a phenolic resin, a mixture of phenolic resins, and a dopant of, for example, a silicon oxide (TiSi dispersion), a continuous film of pyrolyzed polyacrylonitrile with a coating thereover of a hydrolyzed 3-aminopropyltriethoxysilane, a mixture of a pyrolyzed polyacrylonitrile, a metal oxide like titanium oxide, a mixture of pyrolyzed polyacrylonitrile (PPAN) and a hydrolyzed 3-aminopropyltriethoxysilane; a photoconductive imaging member comprised of a supporting substrate, a pyrolyzed polyacrylonitrile hole blocking layer; a photoconductive imaging member wherein the hole blocking layer is of a thickness of about 0.001 to about 50 microns, or is of a thickness of about 0.1 to about 25 microns preferred; a photoconductive imaging member comprised in the sequence of a supporting substrate, a pyrolyzed polyacrylonitrile hole blocking layer, an adhesive layer, a photogenerating layer and a charge transport layer; a photoconductive imaging member wherein the adhesive layer is comprised of a polyester with an $M_w$ of about 70,000, and an $M_n$ of about 35,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in a resinous binder in an amount of from about 5 percent by weight to about 95 percent by weight; a photoconductive imaging member wherein the photogenerating resinous binder is selected from the group consisting of polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the charge transport aryl amines are of the formula

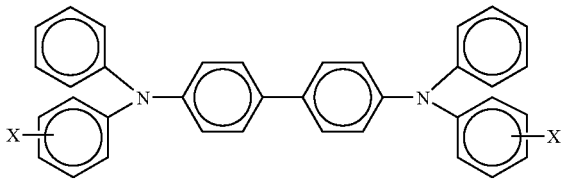

wherein X is selected from the group consisting of alkyl and halogen, and wherein the aryl amine is dispersed in a resinous binder; a photoconductive imaging member wherein for the aryl amine alkyl is methyl, wherein halogen is chlorine, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of from about 50,000 to about 100,000, and an $M_n$ of from about 30,000 to about 40,000; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; and a photoconductive imaging member comprised of a supporting substrate, a pyrolyzed polyacrylonitrile hole blocking layer thereover, a photogenerating layer, and a charge transport layer, and wherein the hole blocking layer is generated from a pyrolyzed polyacrylonitrile, a titanium oxide, such as titanium oxide or titanium dioxide, dispersed in a phenolic resin, or a mixture of phenolic resins, and wherein one of the resins contains at least two phenolic groups, and a dopant.

The hole blocking or undercoat layers for the imaging members of the present invention contain a pyrolyzed, that is for example heating at from about 300° C. to about 350° C. polyacrylonitrile as illustrated herein. More specifically, the pyrolyzed polyacrylonitrile can be prepared as illustrated in W. R. Sorenson and T. W. Campbell, *Preparative Methods of Polymer Chemistry*, Interscience Publishers, Inc., N.Y., 1961, pages 169–171, for example; and C. L. Renschler and A. P. Sylwester, *Appl. Physics Lett.*, 50, (20), 1420 (1987), the disclosures of each of the aforementioned publications being totally incorporated herein by reference. As dispersion binders for the pyrolyzed polyacrylonitrile (PPAN) there can be selected poly(hydroxyalkyl-methacrylates), polyamides, phenolic resins as illustrated herein, polyvinylbutyral, polyvinylbenzyl alcohol, FX-3 component layer which includes polyvinylbutyral, 3-aminopropyltrimethoxysilane and zirconium acetylacetonate. Additionally, the PPAN can be used as a continuous film, which can be, for example, from about 0.0001 micron to about 30 microns with about 0.1 to about 10 microns being preferred. PPAN can also be dispersed in binders, such as a phenolic resin, polyamides and poly(2-hydroxyethyl methacrylate), wherein the amount of PPAN selected can be from about 0.01 percent to about 50 percent by weight with from about 0.1 to about 25 percent by weight being preferred. In an embodiment, the pyrolyzed polyacrylonitrile is crosslinked, and is of the formula:

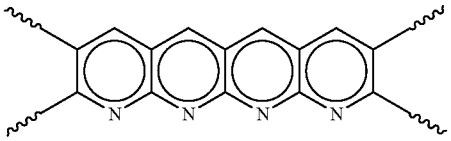

Illustrative examples of substrate layers selected for the imaging members of the present invention can be opaque or substantially transparent, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 50 weight percent of the Type V and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis (benzimidazo)perylene, titanyl phthalocyanines, and the like, and more specifically vanadyl phthalocyanines, Type V hydroxygallium phthalocyanines, and inorganic components such as selenium, especially trigonal selenium, selenium alloys, and the like. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 micron when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin, present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally are of a thickness of from about 5 microns to about 75 microns, and preferably of a thickness of from about 10 microns to about 40 microns, include molecules of the following formula

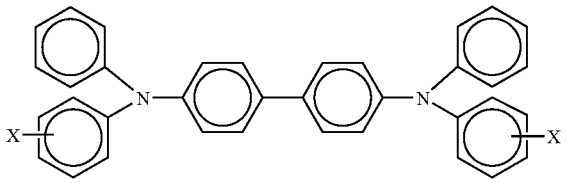

dispersed in a highly insulating and transparent polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference. Examples of the highly insulating and transparent polymer binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Preparation of Polyacrylonitrile:

A 500 milliliter, 3-neck round bottom flask was fitted with a nitrogen inlet, a stirrer and a reflux condenser. The flask was then immersed in an ice bath at 35° C. and flushed for 15 minutes with nitrogen. Then, 120 milliliters of freshly boiled distilled water were added with stirring, and the nitrogen flow was reduced to a slow rate under a silicone oil bubbler. Sodium lauryl sulfate (2 grams), inhibitor free acrylonitrile (80 grams), potassium persulfate (0.1 gram) and sodium bisulfite (0.33 gram) were then added. Within 5 to 20 minutes, the reaction mixture turned to a milky appearance and the polymerization was allowed to continue for 3 hours. After stirring overnight, about 18 to 20 hours, at 25° C., the stable dispersion was freeze-dried to yield primary particles of polyacrylonitrile of a diameter of about 0.01 to about 0.03 micron.

EXAMPLE II

Pyrolysis of Particulate Polyacrylonitrile:

Conductive powders were generated by the pyrolysis of the above prepared polyacrylonitrile powder or films at from about 260° C. to about 500° C. for between 3 and 24 hours. The heating of the polyacrylonitrile powder (20 grams) produced the following quantities of PPAN (pyrolyzed polyacrylonitrile) (the yield with temperature and heating time is given in parentheses): 16.5 grams (82.5 percent, 4 hours, at 260° C.), 16 grams (80 percent, 8 hours, at 260° C.), 165.3 grams (76.5 percent, 8 hours, at 300° C.), 13 grams (65 percent, 4 hours, at 350° C.), 11.7 grams (58.5 percent, 4 hours, at 400° C.), and 1.3 grams (6.5 percent, 2 hours, at 500° C.). Lower reaction temperature (below 300° C.) resulted in incompletely pyrolyzed product, and higher reaction temperature can cause the product to decompose. The optimal pyrolysis temperature was between 300° C. and 350° C.

EXAMPLE III

Undercoats with Powder PPAN in Phenolic Resin Binder:

A 36 percent solids dispersion containing phenolic resin, available from Borden Chemical, Inc., and titanium dioxide (STR-60 needle type) 1:1 by weight in 1-butanol was made using a Dynomil. This dispersion (27.39 grams) and pyrolyzed polyacrylonitrile particles (1.23 grams, obtained from freeze-dried particles of polyacrylonitrile that were pyrolyzed for 8 hours at 300° C.) were combined and roll-milled for 4 days with 140 grams of stainless-steel shot (0.25 inch diameter). The resultant dispersion was pressure filtered through 0.5 micron TEFLON® filter cloth and then coated on a 30 millimeter aluminum mirror drum substrate at 150 millimeters/minute using an annular ring coater. A charge generator layer 0.1 micron thick comprised of hydroxygallium phthalocyanine pigment and VMCH binder (from Dow Chemicals) by 1:1 weight ratio was then applied using a dip coater, and a charge transport layer thickness of about 24 microns comprised of N,N'-diphenyl-N,N-bis(3-methyl phenyl)-1,1'-biphenyl-4,4'-diamine and polycarbonate PCZ-400 by 1:1 weight ratio was then coated on the top of the charge generator layer. The total device thickness was about 26 microns. The resulting drum showed undesirable plywood effects. In a motionless scanner test, the drum showed photo-induced discharge residual potential 10 volts at 8 erg/$cm^2$ exposure, and provided excellent stable electrical properties throughout 10,000 charge, expose and erase cycles.

EXAMPLE IV

Undercoats with Powder PPAN in Polyvinylbenzyl Alcohol Binder:

To a 150 milliliter amber screw-cap bottle was added poly(vinylbenzyl alcohol-co-vinylbenzyl acetate) (5 grams) ($M_w$=44,000, from Scientific Polymer Products Co.) in ethanol (28.5 grams). To this solution was added dropwise 3-aminopropyltriethoxysilane (1.71 grams) and then acetic acid (0.37 gram) with stirring. PPAN powder (3.34 grams, obtained from freeze-dried particles of polyacrylonitrile that were pyrolyzed for 8 hours at 300° C.) and 200 grams of stainless-steel shot were then added, followed by roll milling for four days. The resultant dispersion was pressure filtered through a 0.5 micron TEFLON® filter cloth and then coated on 30 millimeter photoreceptor aluminum mirror drum substrates at 150 mm/minute using an annular ring coater. A charge generator layer 0.1 micron thick comprised of hydroxygallium phthalocyanine pigment and VMCH binder (from Dow Chemicals) by 1:1 weight ratio was then applied using a dip coater, and a charge transport layer about 24 microns thick comprised of N,N'-diphenyl-N,N-bis(3-methyl phenyl)-1,1'-biphenyl-4,4'-diamine and polycarbonate PCZ-400 by 1:1 weight ratio was then coated on the top. The total device thickness was about 26 microns. The resulting drum showed no undesirable plywood effects. In a motionless scanner test the drum showed photo-induced discharge residual potential 30 volts at 6 erg/cm$^2$ exposure and gave excellent stable electrical properties throughout 10,000 charge, expose and erase cycles. Charge diffusion spots were negligible in a printing test.

EXAMPLE V

Undercoats with Powder PPAN in Poly(hydroxybutyl acrylate) Binder:

Poly(hydroxybutyl acrylate), available from Scientific Polymer Products Inc., with $M_w$=60,000 (5 grams of a 20 percent by weight solids solution in methanol), 5 grams of PPAN (obtained from freeze-dried particles of polyacrylonitrile that were pyrolyzed for 8 hours at 300° C.) in ethanol (30 grams) and stainless steel shot 300 grams were roll milled for four days. The resultant dispersion was pressure filtered through 0.5 micron TEFLON® filter cloth. To this solution was added dropwise 3-aminopropyltriethoxysilane (1.35 gram) and then acetic acid (0.15 gram) with stirring. The resultant mixture was coated on Ti/Zr-metallized polyester film using a 1 mil Bird bar applicator. Then a charge generator layer 0.2 micron thick comprising hydroxygallium phthalocyanine pigment and polycarbonate PCZ-200 binder by 1:1 weight ratio was then applied using a 0.5 mil Bird bar applicator and a charge transport layer about 24 micron thick comprised of N,N'-diphenyl-N,N-bis(3-methyl phenyl)-1,1'-biphenyl-4,4'-diamine and polycarbonate MAKROLON™ by 1:1 weight ratio was then coated on the top. The total device thickness was about 32 microns. The resulting photoreceptor device had excellent stable electrical properties throughout 10,000 charge, expose and erase cycles in Xerox 4000 Scanner test fixture.

EXAMPLE VI

Undercoats with Continuous PPAN Films:

A solution of polyacrylonitrile (5 grams) in 70 grams of N,N-dimethylformamide was prepared and used for coating in a Tsukiage coater, annular ring coater, on 30 millimeters photoreceptor aluminum drum substrates. The coated films, between 5 and 7 microns thick, were initially clear, water-white, but on heating, the coatings changed color. The PPAN films turned gold when heated from 25° C. to 350° C. at 4° C. per minute, then brown-black after 4 hours at 350° C. On the top of the continuous PPAN film was coated a hydrolyzed 3-aminopropyltriethoxysilane layer and an adhesion layer in accordance with U.S. Pat. No. 4,464,450, the disclosure of which is totally incorporated herein by reference. A charge generator layer, 0.1 micron thick, comprising hydroxygallium phthalocyanine pigment and VMCH binder, obtained from Dow Chemicals, by 1:1 weight ratio were then applied using a dip coater, and a charge transport layer, 24 microns thick, comprising N,N'-diphenyl-N,N-bis(3-methyl phenyl)-1,1'-biphenyl-4,4'-diamine and polycarbonate PCZ-400 by 1:1 weight ratio was then coated on the charge generator layer. The total device thickness was about 26 microns. The resulting drum indicated no undesirable plywood effects. In a motionless scanner test, the drum showed photo-induced discharge residual potential 20 volts at 8 erg/cm$^2$ exposure.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of an optional supporting substrate, a hole blocking layer, a photogenerating layer, and a charge transport layer, and wherein the hole blocking layer is comprised of a pyrolyzed polyacrylonitrile.

2. An imaging member in accordance with claim 1 wherein said pyrolyzed polyacrylonitrile is dispersed in a resin binder.

3. An imaging member in accordance with claim 1 further comprising a silane monomer.

4. An imaging member in accordance with claim 3 wherein said silane monomer is an aminopropyltriethoxy silane.

5. An imaging member in accordance with claim 4 wherein said silane monomer is a hydrolyzed 3-aminopropyltriethoxy silane.

6. An imaging member in accordance with claim 1 wherein the hole blocking layer is formed from a dispersion comprising said pyrolyzed polyacrylonitrile and a silane monomer.

7. An imaging member in accordance with claim 6 wherein said silane monomer is a hydrolyzed 3-aminopropyltriethoxy silane.

8. An imaging member in accordance with claim 1 wherein said pyrolyzed polyacrylonitrile is admixed with a metal oxide and optionally with a silane monomer.

9. An imaging member in accordance with claim 8 wherein the metal oxide is a titanium oxide, and said silane monomer is an aminoalkoxy silane.

10. An imaging member in accordance with claim 1 wherein said pyrolyzed polyacrylonitrile is admixed with a metal oxide, and a resin binder.

11. An imaging member in accordance with claim 10 wherein the resin binder comprises a first phenolic resin.

12. An imaging member in accordance with claim 11 wherein the first phenolic resin is a linear or nonlinear phenolic resin, and the resin binder further comprises a second phenolic resin containing at least two hydroxy groups.

13. A photoconductive imaging member in accordance with claim 11 further including a second phenolic resin that contains at least two hydroxy groups.

14. An imaging member in accordance with claim 10 wherein said resin binder is a poly(hydroxyalkyl-methacrylate), polyvinylbenzyl alcohol, a polyvinyl butyral, or a polyvinyl acetal.

15. An imaging member in accordance with claim 13 wherein said resin binder contains dispersed therein an organic silane monomer.

16. A photoconductive imaging member in accordance with claim 13 wherein said resin binder comprises from about 1 to about 99 weight percent of the first phenolic resin, and from about 99 to about 1 weight percent of the second phenolic resin.

17. A photoconductive imaging member in accordance with claim 1 wherein said hole blocking layer is of a thickness of about 0.001 to about 5 microns.

18. A photoconductive imaging member in accordance with claim 1 wherein said hole blocking layer is of a thickness of about 0.1 to about 5 microns.

19. A photoconductive imaging member in accordance with claim 1 comprised in the following sequence of a supporting substrate, said hole blocking layer, an adhesive layer, said photogenerating layer, and said charge transport layer, wherein the charge transport layer is a hole transport layer.

20. A photoconductive imaging member in accordance with claim 1 wherein the supporting substrate is comprised of a conductive metal substrate, and optionally which substrate is aluminum, aluminized polyethylene terephthalate or titanized polyethylene terephthalate.

21. A photoconductive imaging member in accordance with claim 1 wherein said photogenerating layer is of a thickness of from about 0.05 to about 10 microns, and wherein said transport layer is of a thickness of from about 10 to about 50 microns.

22. A photoconductive imaging member in accordance with claim 1 wherein the photogenerating layer is comprised of photogenerating pigments dispersed in a resinous binder in an optional amount of from about 5 percent by weight to about 95 percent by weight, and optionally wherein the resinous binder is selected from the group consisting of polyesters, polyvinyl butyrals, polycarbonates, polystyrene-b-polyvinyl pyridine, and polyvinyl formals.

23. A photoconductive imaging member in accordance with claim 1 wherein the charge transport layer comprises aryl amines, and which aryl amines are optionally of the formula

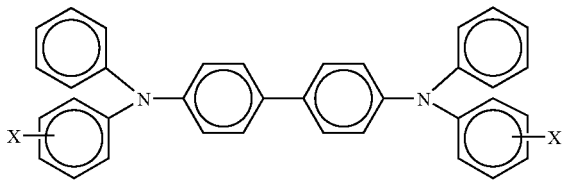

wherein X is selected from the group consisting of alkyl and halogen, and wherein the aryl amine is dispersed in a highly insulating and transparent resinous binder.

24. A photoconductive imaging member in accordance with claim 23 wherein the aryl amine is N,N'-diphenyl-N, N-bis(3-methyl phenyl)-1,1'-biphenyl-4,4'-diamine.

25. A photoconductive imaging member in accordance with claim 1 wherein the photogenerating layer is comprised of metal phthalocyanines, or metal free phthalocyanines.

26. A photoconductive imaging member in accordance with claim 1 wherein the photogenerating layer is comprised of titanyl phthalocyanines, perylenes, or hydroxygallium phthalocyanines.

27. A photoconductive imaging member in accordance with claim 1 wherein the photogenerating layer is comprised of Type V hydroxygallium phthalocyanine.

28. A photoconductive imaging member in accordance with claim 1 wherein said pyrolyzed polyacrylonitrile is formed by heating at a temperature of from about 300.degree. C. to about 350.degree. C.

29. A photoconductive imaging member in accordance with claim 1 wherein said pyrolyzed polyacrylonitrile is formed by heating at a temperature of from about 275.degree. C. to about 325.degree. C.

30. A photoconductive imaging member in accordance with claim 1 wherein said pyrolyzed polyacrylonitrile is crosslinked, and is of the formula

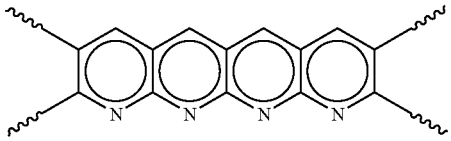

31. A photoconductive imaging member in accordance with claim 1 wherein said pyrolyzed polyacrylonitrile is in the form of a continuous film.

32. A photoconductive imaging member containing a photogenerating layer, a charge transport layer, and a pyrolyzed polyacrylonitrile hole blocking layer, wherein said pyrolyzed polyacrylonitrile is crosslinked, and is of the formula

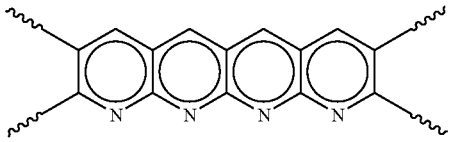

33. A photoconductive imaging member comprising a photogenerating layer, a charge transport layer, and a hole blocking layer, wherein the hole blocking layer comprises pyrolyzed polyacrylonitrile particles.

34. A photoconductive imaging member comprising a photogenerating layer, a charge transport layer, and a hole blocking layer, wherein the hole blocking layer comprises a film of pyrolyzed polyacrylonitrile and a hydrolyzed 3-aminopropyltriethoxysilane layer thereover.

* * * * *